United States Patent [19]

Schmanski et al.

[11] 4,061,435

[45] Dec. 6, 1977

[54] ROADWAY DELINEATOR

[76] Inventors: Donald W. Schmanski; Thomas J. Rose, both of P.O. Box 1298, Carson City, Nev. 89701

[21] Appl. No.: 716,021

[22] Filed: Aug. 19, 1976

[51] Int. Cl.[2] ..... E01F 9/00

[52] U.S. Cl. ..... 404/10; 256/1; 256/13.1; 40/125 N; 40/145 A

[58] Field of Search ..... 404/10, 9; 256/13.1, 256/1; 52/725; 40/125 N, 145 A

[56] References Cited

U.S. PATENT DOCUMENTS

| | | | |
|---|---|---|---|
| 449,125 | 3/1891 | Lieb | 256/13.1 X |
| 1,106,826 | 8/1914 | Michod | 256/13.1 X |
| 1,964,404 | 6/1934 | Lynch | 256/13.1 X |
| 2,136,415 | 11/1938 | Cornett | 256/13.1 |
| 2,646,969 | 7/1953 | Hendrickson | 256/13.1 |
| 3,091,997 | 6/1963 | Byrd | 404/10 |
| 3,709,112 | 1/1973 | Ebinger | 404/10 |
| 3,875,720 | 4/1975 | Russell | 52/725 |
| 3,987,593 | 10/1976 | Svensson | 404/10 X |

*Primary Examiner*—Nile C. Byers
*Attorney, Agent, or Firm*—Criddle, Thorpe & Western

[57] ABSTRACT

A post designed for sign post or guide marker use that will yield on impact and that will resume substantially its original configuration after the impact force has been removed. The post is formed as a single member, but with formed longitudinal shear planes to allow it to split along such shear planes upon impact, thereby reducing the tendency of the post to shear transversely. Correspondingly shaped caps and restrainers may be used during placement of the posts and to insure cohesiveness after shearing has occurred.

8 Claims, 14 Drawing Figures

ROADWAY DELINEATOR

BRIEF DESCRIPTION OF THE INVENTION

1. Field of the Invention

This invention relates to roadway markers or guide posts. More particularly, it is concerned with resilient posts for the purpose, that will deflect on impact and will thereafter return to their original position to continue functioning as intended when installed.

2. Prior Art

The need for resilient posts to carry roadway marking signs has previously recieved at least limited recognition. U.S. Pat. No. 3,875,720, for example, shows such a resilient post made from a bundle of flexible rods that are held together but that are allowed to slide relative to one another during bending of the post. Other known yieldable posts have utilized fixed structures with spring mountings to provide flexibility.

It has been recognized that there is considerable expense involved whenever a rigid post is hit by a vehicle. Not only is the post generally destroyed, or damaged so severely that it must be replaced, but often the damage to the vehicle is quite extensive. Furthermore, once the post has been knocked down, it may take a long period of time to get it replaced.

While, as noted above, other resilient posts for signs have been known, they have not been widely used. Also, to my knowledge, resilient posts have not been generally used as delineators, i.e. traffic guides including road edge markers, traffic directors in parking lots, etc. It is believed that the reasons for such slow underspread acceptance are the costs resulting from the use of springs and the like. In addition, initial costs of a sign post such as is disclosed in the aforementioned U.S. Pat. No. 3,875,720, includes the labor incident to bundling of the flexible rods and the clamping of the rods to rigid sections. Additionally, the cost of collars to clamp the rods together for every pole adds greatly to the expense of the post.

SUMMARY OF THE INVENTION

Principal objects of the present invention are to provide a resilient post suitable for use either as a sign post or as a traffic delineator and that is formed as a single extrusion or pultrusion to be easily handled and positioned.

Other objects are to provide a post that is attractive, that will separate into flexible component parts upon impact; that will resume its basic configuration after impact; and that can be readily repaired to form a single pole unit.

Still another object is to provide a post that does not require a support collar until at least after it has been subjected to severe impact forces, whereby the expense of such collars can be minimized by applying them only to posts that have been previously submitted to such impact.

Principal features of the invention include an elongate extruded or pultruded post of fiberglass, plastic or other such elastic material, that includes elongate planes along which the post will shear to form a plurality of individual components when the pole is subjected to a transverse impact. The weakened shear planes are produced by decreasing the cross-sectional dimensions of the pole along such planes, utilizing low shear strength fibers along such planes, or by providing extra transversely extending fiber reinforcement through non-shear areas, or by combinations of the foregoing. Replaceable collars are provided to support the post as it is driven and to restore it to essentially preimpact condition and a cap and a tip, both shaped to conform to the cross-sectional configuration of the post, are used to drive the post into the ground. The collars may also provide support structure for signs to be attached to the posts.

Other objects and features will be obvious to a person skilled in the art from the following detailed description, taken with the accompanying drawings.

THE DRAWINGS

In the drawings:

FIG. 1 is a fragmentary perspective view of a post of the invention;

FIG. 2, a horizontal cross section view, taken on the line 2—2 of FIG. 1;

FIG. 3, a perspective of another post of the invention, with cap, collar and tip affixed thereto;

FIG. 4, a transverse section through the post of FIG. 3, taken on the line 4—4 of FIG. 1;

FIG. 5, a side elevation view of the post of FIG. 3, inserted in the ground and after initial impact;

FIG. 6, a similar view of the post after further impact;

FIG. 7, a fragmentary perspective view of another post of the invention, having an I-beam cross-sectional configuration;

FIG. 8, a similar view of a post of the invention having a U-shaped channel, cross-sectional configuration;

FIG. 9, another such view showing a post of circular cross-sectional configuration;

FIG. 10, still another view showing a post of T-shaped cross-sectional configuration;

FIG. 11, a view like that of FIGS. 7–10, but showing a post with a generally H-shaped cross-sectional configuration;

FIG. 12, a fragmentary perspective view of the post of the invention with a traffic sign mounted thereon;

FIG. 13, a vertical section view, taken on the line 13—13 of FIG. 12; and

FIG. 14, a top plan view of the post and sign shown in FIG. 12.

DETAILED DESCRIPTION

Figure 1:
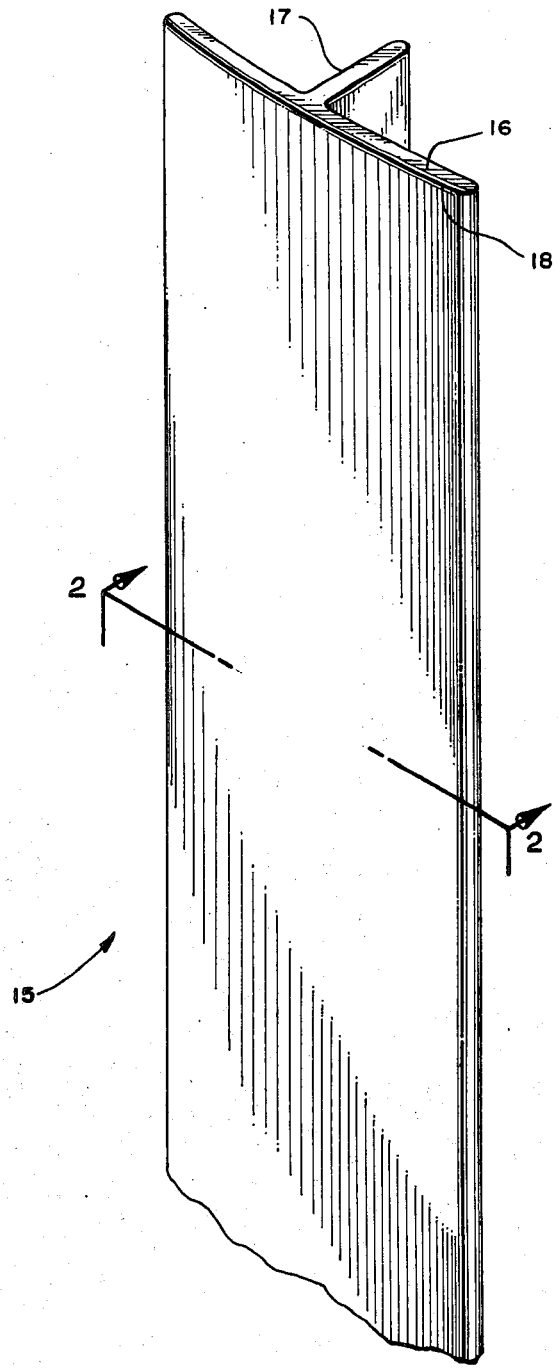
Figure 2:
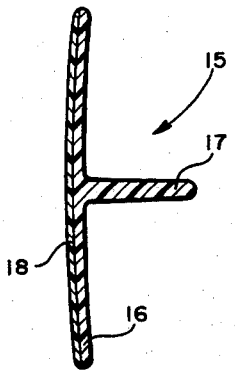
Figure 3:
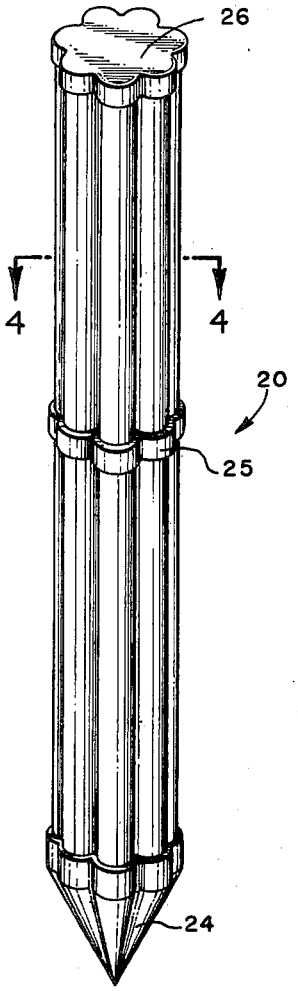

Referring now to the drawings:

In the illustrated embodiment of FIGS. 1 and 2, the post, shown generally at 15 has a generally T-shaped cross section and includes a wide leg 16 of the T that has a face that will serve as a backing for a reflective strip and a smaller leg 17 that provides rigidity to the post. The post 15 is extruded, or pultruded, using fiberglass or similar fiber materials and resins, but a reinforcing layer 18 of fibers and resins is placed over the face of the leg 16 to increase the strength of the leg and to reduce the tendency of the leg to shear along vertical planes. In use, the post 15 is planted on the edge of a roadway or the like, with the face of leg 17 turned in the direction of oncoming traffic or towards the roadway. If the post is struck by a vehicle, the impact will normally be against the face of leg 16, bending the post and causing shearing between the legs 16 and 17, along the shear plane 19, shown in dotted lines.

In the illustrated preferred embodiment shown generally in FIGS. 3–6, the post 20 is extruded or pultruded (both being well known processes for producing such articles) into a desired cross-sectional configuration. As shown in FIGS. 3–6, the generally rosette shaped post 20 has an elongate central core 21, with a cluster of elongate rods 22 therearound. While the central core and elongate rods are formed as a single piece, the shape of the clustered rods is such that a weekened longitudinal section is provided between the central core and each clustered rod. This weakened longitudinal section is best shown by the dotted lines 23 in FIG. 4, and may, if desired, include low shear strength fibers in the shear planes.

A pointed tip 24 telescopes onto one end of the post 20, surrounds the central core 21 and rods 22 and is preferably pointed to facilitate driving of the post into the ground.

A collar 25 has an opening therethrough that conforms in shape to the exterior of the post and the collar is adapted to slide snugly over the post. At least one of the collars is preferably fitted over the post and is placed intermediate its length whenever the post is to be driven into the ground. A cap 26 has a flat upper, impact receiving surface and a lower recess therein that is shaped to conform to the cross-sectional configuration of the post and a solid upper surface, whereby the cap will fit snugly over the end of the post and impact forces can be applied to the cap to drive it into the ground.

It will be apparent that where the post is planted in a preformed hole prepared therefore in the ground, the tip 24, collar 25, and cap 26 will not be required. It will also be apparent that once the post has been planted by driving, the cap 26 and collar 25 can be removed from the top of the post to be used in driving another post.

Figure 5:
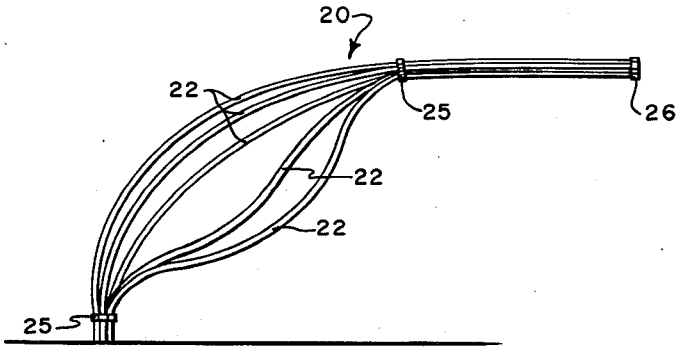
Figure 6:
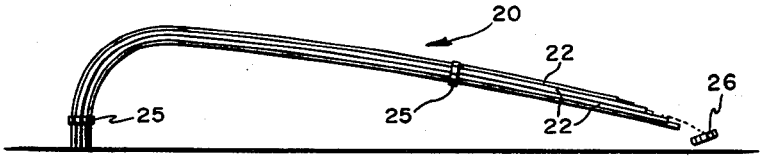
Figure 4:
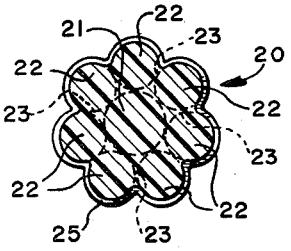

When the post 20 has been placed in the ground and a transverse impact force is applied thereto, such as occurs if the post is struck by a motor vehicle, or the like, the post will bend as shown in FIGS. 5 and 6, with the impact causing the post to shear along the longitudinal weakened sections. Whether the shearing is complete along the lengths of the post, or only partial, the individual components formed after shearing occurs, i.e. the central core and elongate rods will bend in response to such force application whether or not shearing between longitudinal weakend sections is complete, will depend on the nature of the impact applied thereto. If incomplete shearing occurs, the individual components may bend or buckle, see FIG. 5 but, since they are still partially connected they will readily resume the original post configuration. It has been found that if the shearing is complete the individual components, while tending to return to the original post shape, do not always assume the properly assembled configuration. Nevertheless, they still serve a warning or support function that could not be performed by a rigid post that has been sheared off.

Once longitudinal shearing of the post 20 has become complete or when at least one of the individual components has fully sheared from the rest of the post, the life of the post can be extended by sliding one or more of the collars 25 over the post to again tie all of the individual components into a cohesive post of the desired configuration. Since the collars will hold the post configuration while still allowing the individual components to slide with respect to one another, the collar or collars will not adversely affect the ability of the post to bend and to recover to its original condition.

Figure 7:
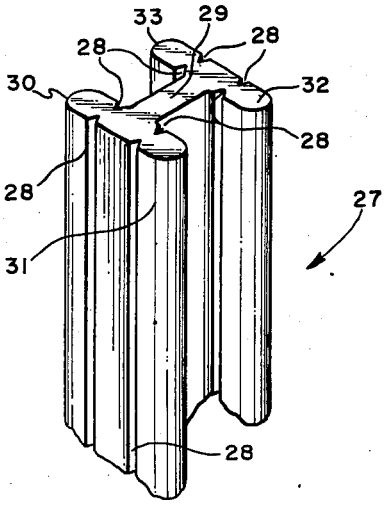

While the T-shaped and rosette cross-sectional configurations shown in FIGS. 1–6 are very satisfactory, other shapes can be used. For example, as shown on FIG. 7, the post shown generally at 27 can be of I-shape cross-sectional configuration and shear lines can be provided, as shown at V-slots 28, where the flanges of the post join the web of the post. The web 29 and flange extensions 30, 31, 32 and 33 then make up the individual components of the post. Still other configurations can be used, and typical arrangements are shown in FIGS. 8–11.

Figure 8:
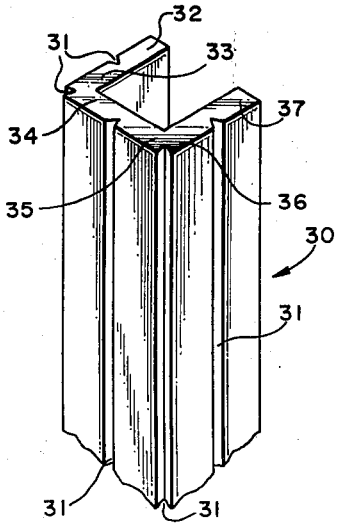

In FIG. 8, a channel shaped post shown generally at 30, is provided. In this post, longitudinal shear lines 31, i.e. weakened planes, are provided intermediate each leg and the web of the post and at the junctions of the legs and the web to make up individual components 32, 33, 34, 35, 36 and 37.

Figure 9:
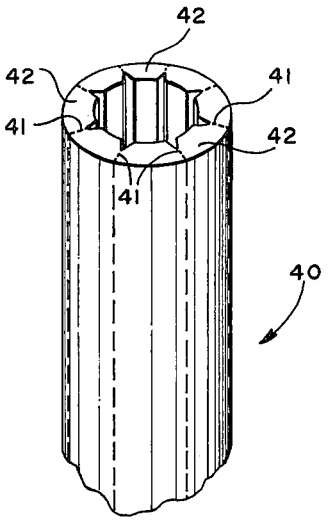

As shown in FIG. 9, the post 40 can also be of round tubular configuration, with the longitudinal shear lines 41 spaced around the post to separate individual components 42.

Figure 10:
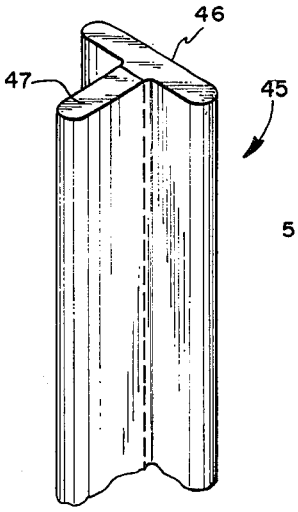

In FIG. 10, there is shown a post 45 of T-shaped cross-sectional configuration and with a shear line at the intersection of the legs 46 and 47 of the T and with the legs of the T forming the individual components of the post.

Figure 11:
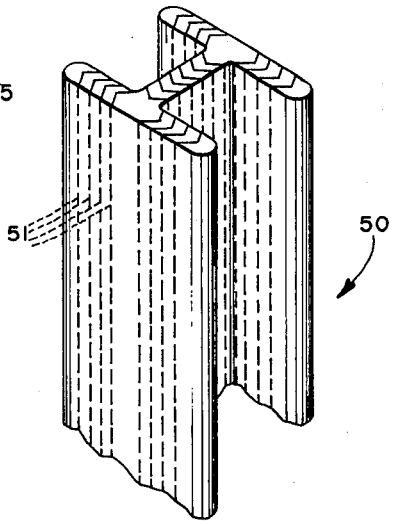

A post 50 of generally H-shaped cross-sectional configuration is shown in FIG. 11. In this post, nested V-shaped longitudinal shear lines 51 are formed in the flanges and web of the post so that a multiplicity of individual components can be formed from each flange and the web when longitudinal shearing occurs in response to impact on the post.

As previously noted, the post of the invention is particularly useful when used as a traffic delineator. Generally, when it is so used, the post will be planted in a pattern with other such posts to direct traffic. Typically, such posts will be used at the sides of roads, in parking lots or at steep embankments to warn a driver that he should not drive beyond the posts.

Figure 12:
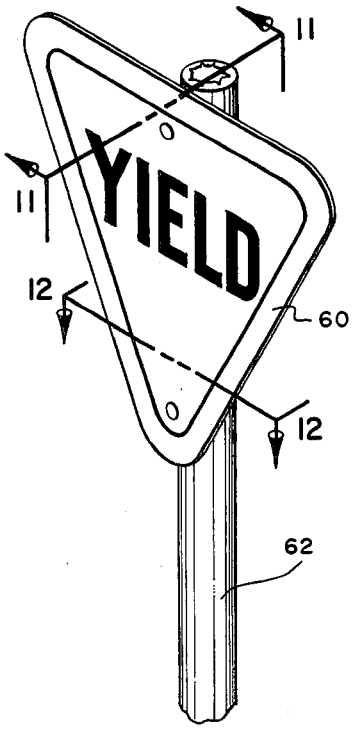
Figure 13:
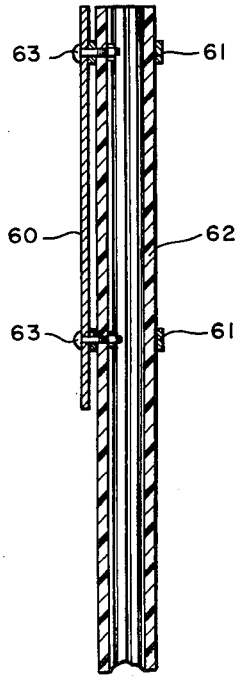
Figure 14:
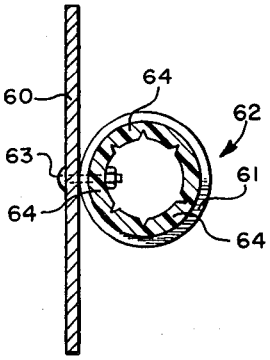

The post of the invention can also be used as a sign post to support highway marking signs. When used for this purpose, the sign 60 (FIGS. 12–14) is preferably affixed to a collar 61 that will closely slide over the post 62 and a bolt 63, which bolt 63 may be the same bolt securing the sign to the collar, is inserted through only one of the individual components of the post and is secured thereto with a nut or the like. With the sign so mounted, all of the individual components of the post are free to separate from one another and all of the individual components can buckle or slide with respect to one another in the manner previously described in the event the post is struck, while elastically returning to their original position after such impact.

Although preferred forms of our invention have been herein described, it is to be understood that the present disclosure is by way of example and that variations are possible without departing from the scope of the hereinafter claimed subject matter, which subject matter we regard as our invention.

We claim:

1. A roadway delineator comprising
   an elongate post made of elastic materials and having at least one longitudinal shear plane extending substantially the length of the post, and individual components separated by each said longitudinal shear plane;
   a collar surrounding the post at one end thereof;
   a highway marker sign affixed to the collar; and
   means affixing the collar to only one of the individual components of the post.
2. A roadway delineator comprising an elongate post made of elastic materials and having at least one longitudinal shear plane extending substantially the length of the post, and individual components separated by each said longitudinal shear plane;

a pointed tip telescoped onto one end of the post;

at least one collar closely fitting around and slidable on the post;

a cap having a flat, impact receiving upper surface and a lower recess closely fitting over the other end of the post;

a highway marker sign affixed to the collar; and means fixing the collar to only one of the individual components of the post.

3. A roadway delineator comprising an elongate post made of elastic materials and having at least one longitudinal shear plane extending substantially the length of the post, each said shear plane being at least partially formed by a reduction in thickness of the post material at such plane, and individual components separated by each such longitudinal shear plane.

4. The roadway delineator of claim 3, further including at least one collar extending at least partially around and slidable on said post, whereby said collar holds said individual components in a bundled together relationship.

5. A roadway delineator comprising an elongate post made of elastic materials and having at least one longitudinal shear plane extending substantially the length of the post, each said shear plane is at least partially formed by using fibers of lower tensile strength in said planes than are used elsewhere in the delineator, and individual components separated by each such longitudinal shear plane.

6. The roadway delineator of claim 5 further including at least one collar extending at least partially around and slidable on said post, whereby said collar holds said individual components in a bundled together relationship.

7. A roadway delineator comprising an elongate post made of elastic materials and having at least one longitudinal shear plane extending substantially the length of the post, each said shear plane is at least partially formed by providing a reinforcement layer including transversely extending fibers on areas of the delineator other than each said shear plane and individual components separated by each such longitudinal shear plane.

8. The roadway delineator of claim 7, further including at least one collar extending at least partially around and slidable on said post, whereby said collar holds said individual components in a bundled together relationship.

* * * * *